US005410110A

United States Patent [19]

Burmeister et al.

[11] Patent Number: 5,410,110

[45] Date of Patent: Apr. 25, 1995

[54] AIR SILENCER MOUNTING ARRANGEMENT

[75] Inventors: Steven D. Burmeister, Grayslake, Ill.; Thomas A. Busse, Kenosha, Wis.; Kathleen A. Hansen, Lake Bluff, Ill.

[73] Assignee: Outboard Marine Corporation, Waukegan, Ill.

[21] Appl. No.: 118,155

[22] Filed: Sep. 8, 1993

[51] Int. Cl.[6] ..... F02M 35/00

[52] U.S. Cl. ..... 181/229; 181/230

[58] Field of Search ..... 181/229, 230; 123/52 M, 123/195 A, 195 C, 198 E; 261/65

[56] References Cited

U.S. PATENT DOCUMENTS

| | | | |
|---|---|---|---|
| 3,782,343 | 1/1974 | Notaras et al. | 123/52 M |
| 3,791,482 | 2/1974 | Sykora | 181/229 |
| 3,975,468 | 8/1976 | Tuckey | 123/52 M |
| 4,592,316 | 8/1986 | Shiratsuchi et al. | 123/195 C |
| 4,620,607 | 11/1986 | Breckenfeld et al. | 181/229 |
| 4,782,912 | 11/1988 | Wandless | 181/229 |
| 5,035,211 | 7/1991 | Mate et al. | 123/198 E |

*Primary Examiner*—Michael L. Gellner
*Assistant Examiner*—Eddie C. Lee

[57] ABSTRACT

Disclosed herein is an air silencer mounting arrangement comprising a carburetor having an air induction passage including an air inlet portion, an air silencer having a wall extending transversely in adjacently spaced relation to the induction passage and including an outlet port in co-axial relation with the air induction passage, a sleeve having an inner end portion received in the inlet portion of the carburetor in telescopic engagement therewith, and an outer end portion, and a ring shaped elastomeric member sealingly engaging the outer end portion of the sleeve and the wall of the air silencer to sealingly and removably connect the air silencer to the carburetor.

17 Claims, 1 Drawing Sheet

AIR SILENCER MOUNTING ARRANGEMENT

BACKGROUND OF THE INVENTION

The invention relates to internal combustion engines and more particularly to the mounting of air silencers on carburetors associated with such internal combustion engines.

Attention is directed to the following United States Patents:

| | | |
|---|---|---|
| 3,791,482 | Sykora | February 12, 1974 |
| 4,592,316 | Shiratshuchi, et al. | June 3, 1986 |
| 4,620,607 | Breckenfeld, et al. | November 4, 1986 |
| 4,782,912 | Wandless | November 8, 1988 |
| 5,035,211 | Mate, et al. | July 30, 1991 |

SUMMARY OF THE INVENTION

The invention provides an air silencer mounting arrangement comprising a carburetor having an air induction passage including an air inlet portion, an air silencer having a wall extending transversely in adjacently spaced relation to the induction passage and including an outlet port in co-axial relation with the air induction passage, a sleeve having an inner end portion received in the inlet portion of the carburetor in telescopic engagement therewith, and an outer end portion, and an elastomeric member sealingly engaging the outer end portion of the sleeve and the wall of the air silencer to removably connect the air silencer to the carburetor.

The invention also provides an air silencer mounting arrangement comprising a carburetor having an air induction tube including an air inlet portion having an outer end and defining an air inlet passage, and a flange extending transversely outwardly from the outer end, an air silencer having a wall extending transversely in adjacently spaced relation to the end of the induction tube and including an outlet port in co-axial relation to the air inlet passage of the air induction tube, and a circular projection extending toward the carburetor in radial outward and coaxial relation to the outlet port, a sleeve having an outwardly extending rib engaged with the flange of the induction tube, an inner end portion extending on one side of the rib and received in the inlet portion of the carburetor in telescopic sealing engagement therewith, and an outer end portion extending from the other side of the rib and including an outer end, and an elastomeric ring-shaped member having an inner opening in alignment with the air inlet passage of the air induction tube and with the outlet port of the air silencer and including an outer transverse wall sealingly engaging the air silencer wall, an inner transverse wall generally parallel to the outer transverse wall and in sealing engagement with the flange of the induction tube, an inclined wall extending from the inner transverse wall and including an inner end having a surface sealingly engaging the outer end portion of the sleeve, and an annular groove extending inwardly from the outer transverse wall and grippingly receiving the circular projection on the air silencer.

Other features of and advantages of the invention will become apparent to those skilled in the art upon review of the following detailed description, claims, and drawings.

Figure 1:
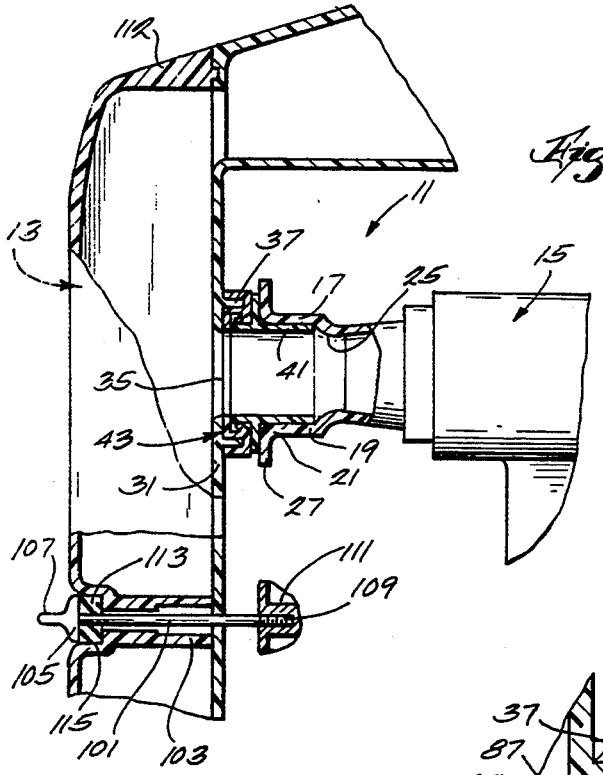
FIG. 1 is a fragmentary view illustrating an arrangement for mounting of an air silencer on a carburetor in accordance with the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is an arrangement 11 for flexibly connecting or mounting an air silencer 13 on a carburetor 15 in a manner which vibrationally isolates the air silencer 13 from the carburetor 15, which affords smooth air entry from the air silencer 13 into the carburetor 15, which can easily be assembled (and disassembled) without the use of tools, and which provides a seal between the air silencer 13 and the carburetor. More particularly, the carburetor 15 can be of any otherwise conventional construction which is fabricated of rigid material, such as metal or rigid plastic, and which includes an induction tube 17 defining an air passage having a circular transverse cross section, and having an outer end portion 19 with an outer end 21 and an inner smooth cylindrical wall surface 23 located upstream of a venturi 25. Preferably, the induction tube 17 also includes a flange 27 which extends transversely radially outwardly of the end 21 of the outer end portion 19 of the air induction tube 17.

The air silencer 13 is fabricated of rigid material such as rigid plastic, and can be generally of conventional construction including a transverse wall or base 31 extending in spaced adjacent relation to the outer end of the carburetor induction tube 17. Located in the transverse wall 31, in general co-axial alignment with the induction tube 17, is a circular outlet port or aperture 35 located in the transverse wall 31, and a short cylindrical projection 37 which extends from the transverse wall 31 toward the carburetor 15 and in radially outward co-axial relation to the aperture 35, and which has an inner surface with a diameter larger than the diameter of the outer surface of the outer end portion 49 of the sleeve 41 still to be described.

The arrangement 11 also includes a mounting sleeve 41 connectable to the induction tube 17 by an interference fit. A resiliently flexible elastomeric member, grommet, or connector 43 captures the projection 37 of the air silencer 13 and has a flexible inclined wall 8 that engages the sleeve 41.

More particularly, the mounting sleeve 41 comprises a tube which is preferably fabricated of rigid material and which is of generally constant circular transverse cross section throughout its axial length, except for a centrally located rib or flange 45 which extends transversely outwardly and which divides the sleeve 41 into an inner end portion 47 extending in one direction from the rib 45 and having an outer diameter closely telescopically engaging the inner cylindrical wall surface 23 of the outer end portion 19 of the induction tube 17, and an outer end portion 49 which extends in the opposite direction from the rib 45. The sleeve 41 also includes a smooth inner cylindrical surface 51.

Preferably, when the inner end portion 47 of the sleeve 41 is telescopically engaged in the air induction tube 17 of the carburetor 15, the inner surface 53 of the rib 45 engages the flange 27 at the outer end 21 of the induction tube 17.

The elastomeric member 43 is preferably fabricated of soft rubber or rubber-like material and is generally of tubular or ring shape. The elastomeric member 43 also includes therein an annular generally cylindrical groove 71 which extends toward the carburetor 15 from the outer transverse wall 61 and which sealingly receives the projection 37 for mounting the elastomeric member 43 on the air silencer 13.

The elastomeric member also includes an outer transverse wall 61 which extends (when engaged with the sleeve 41) outwardly from the outer portion 49 and which includes an aperture 63 aligned with, and of generally the same diameter as, the inner surface 51 of the sleeve 41 and the aperture 35 in the transverse wall 31 of the air silencer 13. The outer transverse wall 61 of the elastomeric member 43 also includes an inner surface 65 engaging the outer end surface 67 of the outer end portion 49 of the sleeve 41 and an outer surface which sealingly engages the transverse wall 31 of the silencer 13.

The elastomeric member 43 also includes a radially outer cylindrical wall 73 which extends from the radially outer end of the transverse wall 61 in coaxial relation to the sleeve 41 and toward the carburetor flange 27, and which assists in defining the groove 71.

The elastomeric member 43 also includes an inner transverse wall 77 which extends in spaced relation to the outer transverse wall 61 and radially inwardly from the cylindrical outer wall 73, which defines the bottom wall of the groove 71, and which engages the outer surface 79 of the rib 45. The inner transverse wall 77 terminates in spaced relation to the outer end portion 49 of the sleeve 41.

The elastomeric member 43 also includes an inclined wall 81 which extends radially inwardly from the inner transverse wall 77 and in inclined relation toward the outer transverse wall 61 and which terminates in an end surface 83 which engages the outer surface of the outer end portion 49 of the sleeve 41 in spaced relation from the rib 45 and in spaced relation to the outer transverse wall 61. Preferably, the end surface is a part of a somewhat enlarged bulbous end sub-portion.

The elastomeric member 43 also includes an inner cylindrical wall 87 which extends between the outer transverse wall 61 and the inner transverse wall 77 and which assists in defining the groove 71.

Figure 2:
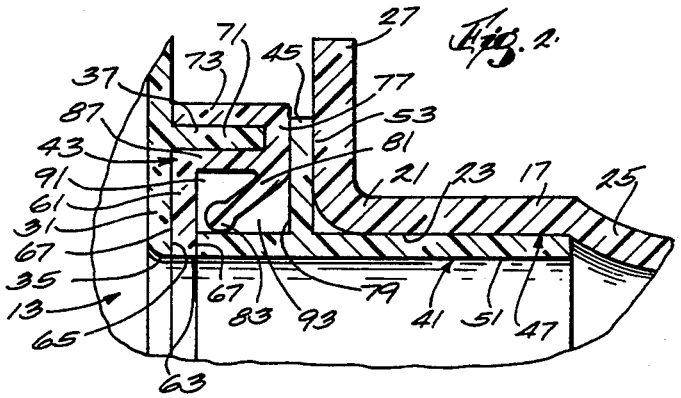
FIG. 2 is an enlarged fragmentary view, in section, of the arrangement employed in FIG. 1 for mounting the air silencer on the carburetor.
Figure 3:
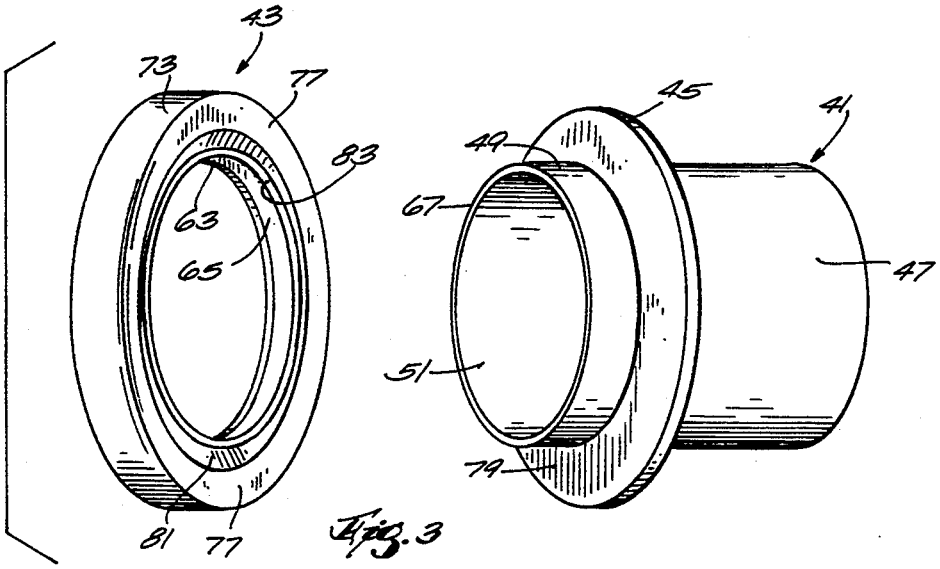
FIG. 3 is an exploded perspective view of two of the components employed for mounting the air silencer on the carburetor.

The outer transverse wall 61, the inner cylindrical wall 87, and the inclined wall 81 define therebetween a void or cavity 91 which is inwardly open but is closed by the outer end portion 49 of the sleeve 41. As can also be seen best in FIG. 2 of the drawings, when the elastomeric member 43 engages on the outer end portion 49 of the sleeve 41, another void or cavity 93 is defined between the inclined wall 81 and the sleeve 41.

As can be readily observed from the drawings, the elastomeric member 43 extends radially outwardly for about the same distance as the rib 45 of the sleeve 41.

If desired, suitable additional means can also be employed to assist in retaining the air silencer 13 in assembled relation to the carburetor. Various arrangements can be employed. For instance, the elastic connectors which are disclosed in U.S. Pat. No. 5,035,211 (incorporated herein by reference) and referred to therein by the reference numerals 130 and 132, can be employed to hold the air silencer 13 tightly against the elastomeric member 43 which, in turn, bears tightly against the sleeve 41 which, in turn, bears tightly against the outer end portion 19 of the carburetor 15. In the disclosed construction, the air silencer 13 is retained in assembled relation with respect to the carburetor(s) by a suitable number (two for example) of hand operable fasteners or knobs 101 which pass through suitable tubular openings 103 formed in the air silencer 13 and which include a head 105 having an outwardly extending knob or gripping portion 107 adapted to be manipulated by the user's hand, and a threaded portion 109 received in the threaded aperture in a suitable bore 111 fixed relative to the carburetor(s) 15. More particularly, the openings 103 are formed in an air silencer cover 112 which is assembled to the base 113 and to the carburetor(s) 15 by the fasteners 101. If desired, a seal 113 can be located in a depression 115 between the head 105 and the air silencer cover 112 to preclude air flow. Thus, the air silencer 13 can be assembled and disassembled relative to the carburetor 15 by an operator and without the use of tools.

The disclosed construction affords ease of assembly and removal of the air silencer 13 on the carburetor 15 without the use of any tools, effectively vibrationally isolates the air silencer 13 from the carburetor 15, permits smooth air flow from the air silencer 13 to the carburetor 15, and seals the connecting air passage between the air silencer 13 and the carburetor 15. While only a single carburetor has been described, in multiple cylinder engines wherein a single air silencer serves a plurality of carburetors, the disclosed construction can be used between each of the carburetors and the air silencer.

Various of the features of the invention are set forth in the following claims.

We claim:

1. An air silencer mounting arrangement comprising a carburetor defining an air induction passage and including an air inlet portion, an air silencer having a wall extending transversely in adjacently spaced relation to said carburetor and including an outlet port in co-axial relation with said air induction passage, a sleeve having an inner end portion received in said inlet portion of said carburetor in telescopic engagement therewith, and an outer end portion, and an elastomeric member sealingly engaging said outer end portion of said sleeve and said wall of said air silencer to removably connect said air silencer to said carburetor.

2. An air silencer mounting arrangement in accordance with claim 1 wherein said wall of said air silencer includes a cylindrical projection in radially outwardly spaced relation from said outlet port, and said elastomeric member includes an annular groove grippingly receiving said projection.

3. An air silencer mounting arrangement in accordance with claim 1 wherein said projection has an inner surface with a diameter, and wherein said outer end portion of said sleeve has an outer surface with a diameter less than said diameter of said projection.

4. An air silencer mounting arrangement in accordance with claim 1 wherein said sleeve has a cylindrical inner surface with a constant diameter.

5. An air silencer mounting arrangement in accordance with claim 1 wherein said end portion of said induction passage includes an outer end, and sleeve also includes a rib extending transversely outwardly and engaged with said elastomeric member and with said air inlet portion of said carburetor.

6. An air silencer mounting arrangement in accordance with claim 1 wherein said air induction passage, said outlet port, and said sleeve are circular in transverse cross section.

7. An air silencer mounting arrangement in accordance with claim 1 wherein said elastomeric member is fabricated of soft rubber and is flexibly resilient.

8. An air silencer mounting arrangement in accordance with claim 1 wherein said sleeve is fabricated of rigid plastic.

9. An air silencer mounting arrangement in accordance with claim 1 wherein said air inlet portion of said carburetor and said air silencer wall are rigid.

10. An air silencer mounting arrangement comprising a carburetor having an air induction tube including an air inlet portion having an outer end and defining an air inlet passage, and a flange extending transversely outwardly from said outer end, an air silencer having a wall extending transversely in adjacently spaced relation to said end of said induction tube and including an outlet port and in co-axial relation to said air inlet passage of said air induction tube, and a circular projection extending toward said carburetor in radial outward and coaxial relation to said outlet port, a sleeve having an outwardly extending rib engaged with said flange of said induction tube, an inner end portion extending on one side of said rib and received in said inlet portion of said carburetor in telescopic sealing engagement therewith, and an outer end portion extending from the other side of said rib and including an outer end, and an elastomeric ring-shaped member having an inner opening in alignment with said air inlet passage of said air induction tube and with said outlet port of said air silencer and including an outer transverse wall sealingly engaging said air silencer wall, an inner transverse wall generally parallel to said outer transverse wall and in sealing engagement with said flange of said induction tube, an inclined wall extending from said inner transverse wall and including an inner end having a surface sealingly engaging said outer end portion of said sleeve, and an annular groove extending inwardly from said outer transverse wall and grippingly receiving said circular projection on said air silencer.

11. An air silencer mounting arrangement in accordance with claim 10 wherein said circular projection has an inner surface with a diameter, and wherein said outer end portion of said sleeve has an outer surface with a diameter less than said diameter of said projection.

12. An air silencer mounting arrangement in accordance with claim 10 wherein said sleeve has a cylindrical inner surface with a constant diameter.

13. An air silencer mounting arrangement in accordance with claim 10 wherein said rib extends transversely from said sleeve for a given distance and wherein said elastomeric member extends transversely outwardly from said outer end portion of said sleeve for a distance approximately the same as said given distance.

14. An air silencer mounting arrangement in accordance with claim 10 wherein said air induction passage, said outlet port, and said sleeve are circular in transverse cross section.

15. An air silencer mounting arrangement in accordance with claim 10 wherein said elastomeric member is fabricated of soft rubber and is flexibly resilient.

16. An air silencer mounting arrangement in accordance with claim 10 wherein said sleeve is fabricated of rigid plastic.

17. An air silencer mounting arrangement in accordance with claim 10 wherein said air inlet portion of said carburetor and said wall of said air silencer are rigid.

* * * * *